United States Patent [19]

Shewmon

[11] Patent Number: 4,612,870

[45] Date of Patent: Sep. 23, 1986

[54] STRUCTURES AND METHODS OF FORMING SEA ANCHORS

[76] Inventor: Daniel C. Shewmon, 1940 Byram Dr., Clearwater, Fla. 33515

[21] Appl. No.: 634,519

[22] Filed: Jul. 26, 1984

[51] Int. Cl.[4] ..... B63B 21/48; B63H 9/04

[52] U.S. Cl. ..... 114/311; 114/103; 244/145

[58] Field of Search ..... 244/145; 114/311, 102, 114/103, 115, 108, 294; 446/49; 112/412, 418, 419

[56] References Cited

U.S. PATENT DOCUMENTS

| | | | |
|---|---|---|---|
| 60,284 | 12/1866 | Upton | 114/311 |
| 65,625 | 6/1867 | Wheeler | 114/311 |
| 129,878 | 7/1872 | Wilson et al. | 114/311 |
| 137,190 | 3/1873 | Fleetwood | 114/311 |
| 1,012,890 | 12/1911 | Miller | 114/311 |
| 1,843,874 | 2/1932 | Hulst | 114/364 |
| 1,951,864 | 3/1934 | Driggs, Jr. | 244/145 |
| 2,134,362 | 10/1938 | Frieder | 244/145 |
| 2,349,833 | 5/1944 | Robinson | 244/145 |
| 2,759,694 | 8/1956 | Lemoigne | 244/145 |
| 2,785,646 | 3/1957 | Meyer | 114/311 |
| 2,818,042 | 12/1957 | Manhart | 114/311 |
| 3,973,236 | 8/1976 | McLaughlin | 114/311 |
| 4,296,704 | 10/1981 | Bridge | 114/103 |

FOREIGN PATENT DOCUMENTS

| | | |
|---|---|---|
| 38564 | 3/1928 | Denmark . |
| 717715 | 2/1942 | Fed. Rep. of Germany . |

OTHER PUBLICATIONS

Research Disclosure Jun. 1981.

Catalog-Brochure "Shewmon Sea Anchors and Drogues" ©1982, Shewmon, Inc.

*Primary Examiner*—Trygve M. Blix

*Assistant Examiner*—Edwin L. Swinehart

*Attorney, Agent, or Firm*—Dowell & Dowell

[57] ABSTRACT

Structures and methods for constructing sea anchors having body portions defined by at least three spaced corners or vertices wherein bail ropes are sewn to and extend diagonally inwardly from each corner toward the center of the body portion so that stresses applied to the stitching are distributed and absorbed by stretching the material along its diagonal lines. In one embodiment of the invention, a sail is disclosed which is reinforced by the method of the present invention and which thereby is capable of serving as a sea anchor during emergencies.

19 Claims, 8 Drawing Figures

STRUCTURES AND METHODS OF FORMING SEA ANCHORS

BACKGROUND OF THE INVENTION

1. Field of the Invention

This invention is generally directed to sea anchors, drogue chutes, boat sails and the like and particularly to a method for simply constructing such structures wherein the stretching characteristics of a fabric main body panel are utilized to reduce stresses placed on seams which secure the bail ropes to the panels by placing bail ropes so as to extend from the corners of the body toward the center thereof so that all stresses placed upon the bail ropes during deployment of the apparatus will be transmitted along the bail ropes and the stitches to the material which is more yieldable along its diagonal seams.

2. History of the Invention

Over the years there have been many attempts to develop safe, low cost, and easy to deploy sea anchors which could be used especially with smaller craft including sailboats, small fishing boats, motorboats and the like. Traditionally, most sea anchors or drogues have been very large and bulky structures designed for use with larger ships and oftentime consisted of a plurality of complicated components which not only presented problems in deployment but also created storage problems aboard ship.

Due to the unavailability of low cost sea anchors or drogues, many small craft owners have simply not obtained such items for use with their vessels. Over the years there have been many tragic accidents and deaths caused which could have been avoided if the proper safety equipment was maintained aboard smaller craft to steady such craft and prevent undue drifting and proper alignment during storms and heavy seas.

The problem is not unique to small craft owners and operators in any one part of the world. In underdeveloped countries where fishing fleets primarily consist of small motorized craft or wind powered craft the failure to have proper safety equipment results in undue risks. These undue risks could be easily avoided if it were possible to develop low cost sea anchors which could be easily deployed, sturdy during use and stored in a minimal amount of storage space.

In an effort to make sea anchor structures more readily compactible, there were various attempts to design collapsible frameworks for carrying the main flexible cloth body of the anchor. Oftentimes these frameworks resulted in complicated structures which necessitated increased cost and in themselves presented storage problems. In addition to making collapsing frames for sea anchors, other prior art developments include reinforced bracing and fabric panel edge seaming to strengthen the main body portion of the sea anchor in order to increase its strength and prevent the sea anchor from failing due to the large forces which are often encountered especially during deployment of a sea anchor in heavy seas. Many of these prior art structures, however, have been bulky making them difficult to deploy and to store. Further, the cost of manufacturing such sea anchors has made their use somewhat prohibitive. In U.S. Pat. No. 2,785,646 to Muyer, a flexible sea anchor structure is disclosed which permits the sea anchor panel to be folded during nonuse. The reinforcing for the sea anchor panel is provided by a rope frame that surrounds the panel and is secured thereto by rolled or piped edges. In order to increase the strength of the panel of the anchor, reinforcing gussets and clamps had to be provided adjacent the edge or corner portion thereof. The additional structure for reinforcement thereby necessitates additional labor, increased costs, and further contributes to the bulkiness of the resultant sea anchor.

Other examples of the prior art include U.S. Pat. Nos. 60,287 to Upton; 65,625 to Wheeler; 129,878 to Wilson et al.; 1,012,090 to Miller; and 2,818,042 to Manhart.

SUMMARY OF THE INVENTION

This invention is directed to a flexible and compactible sea anchor structure for use with generally small craft where the sea anchor has a panel or body portion which is defined by at least three spaced corners and wherein the bail ropes which attach the panel or body member to the main tow line are attached to such panel member by being stitched diagonally inwardly from the corners toward the center of the panel in such a manner that a single stitch passes through two layers of cloth and the bail rope. In another embodiment of the invention, a sail such as a backing spinnaker sail is constructed in generally triangular shape having reinforced cording or rope sewed thereto and extending from each of the corners thereof towards the center or middle portion of the sail panel. The ends of the sail reinforcing ropes adjacent the corners may be formed into loops so that the sail will have an alternate use as a sea anchor or drogue chute especially during stormy weather or heavy seas. When used as a sea anchor, bail ropes are attached to each of the reinforcing cords and are extended outwardly therefrom to a common point. It is a primary object of this invention to provide a low cost and yet extremely durable sea anchor for use with relatively small water vessels and which may be simply constructed and easily stored when not in use.

It is another object of the present invention to provide a method for making sea anchors which will make it possible for even small craft owners to afford and to maintain sea anchors aboard their vessels for emergency use or for use when drifting during periods of fishing or during night hours.

It is yet another object of the present invention to provide a method for making sea anchors which only require that the bail ropes be secured from the diagonal corners inwardly toward the center of the flexible cloth panel forming the main body of the anchor without the need for additional clamping, reinforcing or bolting devices to assure additional strength for the anchor.

It is a further object of the present invention to provide a sea anchor which utilizes the stretching capability of a cloth panel to insure that the seam or stitching between the attached bail rope and the panel remains intact even at the point of failure of the fabric itself.

It is another object of the present invention to provide a method of forming sea anchors which permits such anchors to be constructed utilizing conventional sewing machines without the additional need for shop or mechanical equipment.

It is another object of the, present invention to provide a method for reinforcing a sail and in particular a backing spinnaker sail by providing rope or cordage along the backside of the sail so as to prevent failure of the material by distributing stresses diagonally along the cloth material.

It is still another object of the present invention to provide a sail structure having an alternate utility during emergencies as a sea anchor and which will insure adequate stabilization and exhibit sufficient strength to function to retain small crafts in the proper alignment against the wind during even heavy storms and heavy seas.

DESCRIPTION OF THE PREFERRED EMBODIMENT

Figure 1:
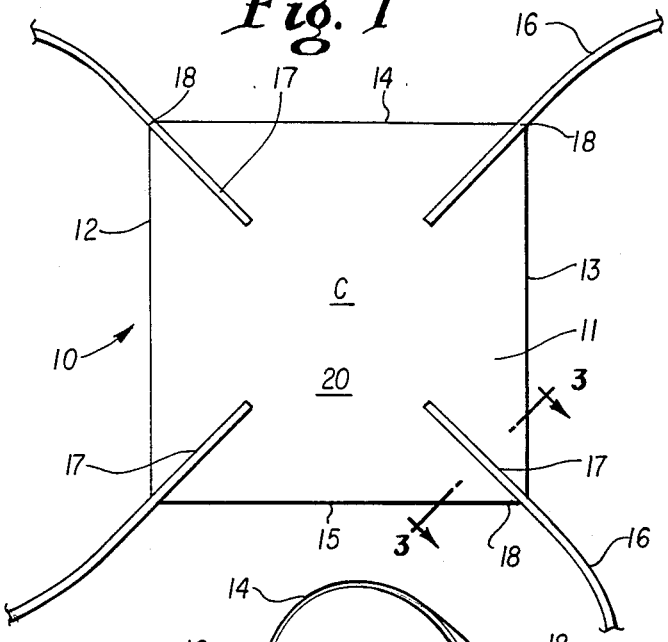
FIG. 1 is a bottom plan view of a square sea anchor made in accordance with the method of the present invention.

With continued reference to the drawings, a typical sea anchor 10 formed in accordance with the present method of invention is disclosed in FIG. 1. This anchor is shown as having a generally square body panel 11 having parallel side walls 12 and 13, and 14 and 15 respectively. If desired, a seam (not shown) may be formed along the outer edge portion around the periphery of the panel. In order to reinforce and strengthen the panel as well as to secure bail ropes 16 thereto, the bail ropes 16 have one end thereof 17 stitched to the fabric panel so as to extend diagonally in a line generally from the center of each vertex or corner 18 of the panel towards the center of the panel generally designated by the letter "C" in FIG. 1.

Figure 2:
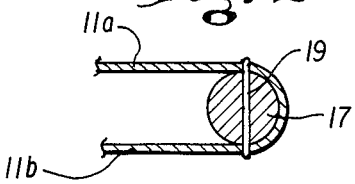
FIG. 2 is an enlarged partial cross-sectional view showing the portion of the cloth panel relative to the bail ropes during sewing.

As shown in the illustration, the end portion 17 of the bail ropes extends only a portion of the way toward the center of the sea anchor panel 11. The reason for the termination will be discussed in greater detail hereinafter. With particular reference to FIG. 2, the method of sewing the bail ropes to the sea anchor panel will be discussed in greater detail. Generally, each bail rope 16 is placed along a diagonal from its respective corner toward the center of the panel and thereafter the body of the fabric layer is folded over so that the end portion 17 of the bail rope 16 is bounded on its upper and lower sides by portions of the fabric panel 11. Thereafter a single or double stitch 19 is made through both the upper and lower fabric layers shown as 11*a* and 11*b*, respectively, in FIG. 2, and through the end portion 17 of the bail rope. Thereafter the upper portion of the panel 11 is extended away or into an unfolded relationship with respect to portion 11*b*, as shown in FIG. 3.

Figure 3:
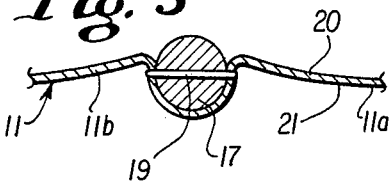
FIG. 3 is an enlarged partially cross-sectional view taken along lines 3—3 of FIG. 1.
Figure 4:
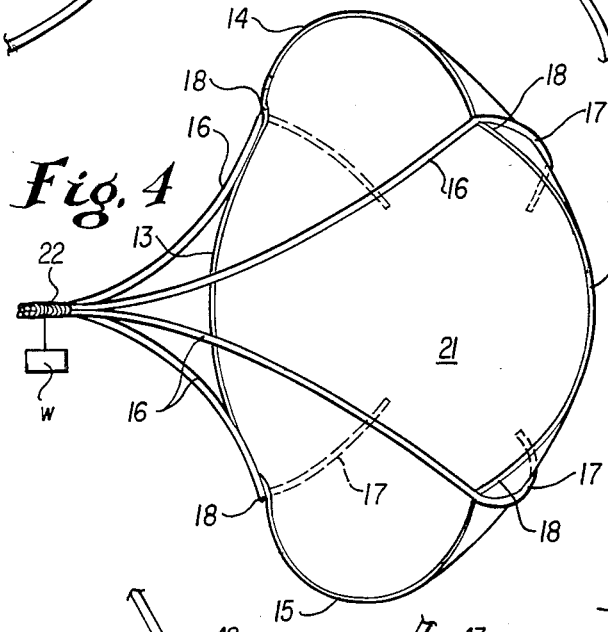
FIG. 4 is an illustration of the sea anchor of FIG. 1 when deployed.

As can be seen from FIG. 3, the stitch secures two portions of the fabric body portion of the sea anchor through the cord and in doing so provides an area of contact substantially equal to half of the diameter of the cord between the cord and the fabric. After the ends of the bail rope have each been secured by sewing in a manner similarly to that discussed above, the bail ropes are pulled around to the opposite side of the fabric panel as shown in FIG. 4. In this manner it will be seen that the end portion 17 of the bail ropes are now positioned along the backside of the sea anchor. The backside of the panels are marked as 20 and the front sides 21. It is desirable that the end portions of the bail ropes be located along the backside of the sea anchor in order to further increase the strength of the seam as pressure is placed on the face or front side 21 of the sea anchor panel as indicated by the arrow in FIG. 4. The placement of the bail ropes along the back will have the resultant effect of having the ropes situated in positions to have portions of the fabric panel forced thereabout during use thereby causing additional surface contact between the rope and the fabric panel. This increased surface contact and the additional force urging the panel against the bail ropes increases the strength of the seam which attaches the rope to the panel.

The bail ropes 16 are extended outwardly an equal distance from the center of the fabric panel member and are tied off in an overhand knot or otherwise bound together as at 22. Thereafter, a drag line (not shown) may be securely attached thereto utilizing a number of conventional, mechanical or direct knotting techniques.

By way of example, a generally square sea anchor such as that shown in FIG. 1 was constructed having sides of $4\frac{1}{2}$ feet in length utilizing a 7 oz. cloth. The cloth could be a polyester, nylon, or dacron material. In this regard, laminated reinforced products may also be used for the cloth panel provided they have a weight of approximately 7 oz to 8 oz. or better per square yard. The bail rope was generally $\frac{1}{4}$ to $\frac{3}{8}$ inch in diameter and constructed of a braided nylon material. Each bail rope should be the same length. In the example, the bail ropes are approximately 20 feet in length. The seams were formed using a nylon or dacron thread although even stronger threads such as Kevlar may be used if necessary. Generally, the end portions of the bail rope are secured to the fabric so as not to extend more than 2 feet to 3 feet along the diagonal line towards the center with approximately $2\frac{1}{2}$ feet being preferable. It was found that if the cords or ropes are extended completely to the center that the increase in overall strength of the unit was not significantly enhanced.

During testing of the sea anchor of the general size and configuration just discussed, it has been found that approximately 3,000 lbs. of pull could be placed upon the sea anchor before the material failed. Even after failure, the seams uniting the bail ropes to the fabric panel remained intact.

Generally, the structure of the sea anchor is such as to be self-opening requiring generally little or no weight. In addition, after deployment the structure permits the sea anchor to run true and below the surface of the water without yawing. In the event of a heavy sea, it may be necessary to attach 3 lbs. to 4 lbs. of weight 10 in the area adjacent the tied ends 22 of the bails but not adjacent the cloth panel itself. The weight will assist in pulling the sea anchor down through heavy breakers in stormy seas.

Figure 5:
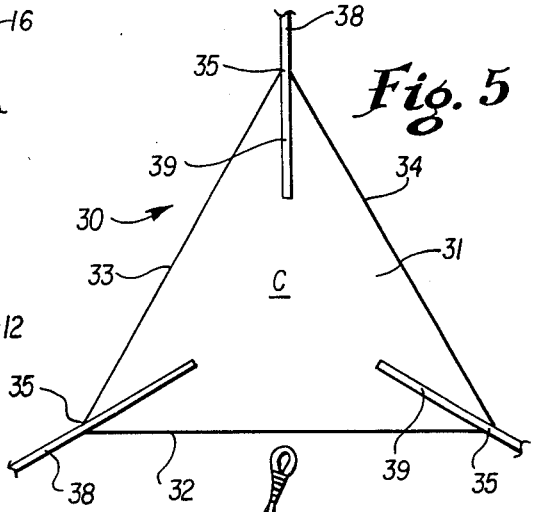
FIG. 5 is an alternate embodiment of the invention showing a three-sided sea anchor.

With particular reference to FIG. 5, another sea anchor 30 is shown which is contructed using the method of the present invention. As noted, the main panel 31 of the sea anchor 30 is generally in the shape of an equilateral triangle having a base portion 32 and inclining side wall portions 33 and 34. The side walls and base edges meet and form three vertexes 35. If a line is drawn which divides the angles at each vertex exactly in half towards the center of the panel member, the center "C" of the triangular panel will be located. For purposes of definition, in this application the term "center" refers to that point in a sea anchor main body or said panel which is defined by the intersection of lines drawn from the vertexes of the panel toward the center thereof and which divide the angle defined by each vertex generally in half.

As in the prior example, the bail ropes, now designated as 38, will have end portions 39 which are sewn in a manner similar to that discussed with respect to FIGS. 1 through 4 so as to extend from each corner 35 toward the center of the triangular panel member. During the use of the sea anchor, the bail ropes will be extended outwardly an equal distance or length away from the center of the panel and brought around to the far side of the panel in a manner similar to that disclosed with regard to FIGS. 1–4 so that the extended end portions of the bail ropes 39 extend along the back side of the sea anchor panel.

Figure 6:
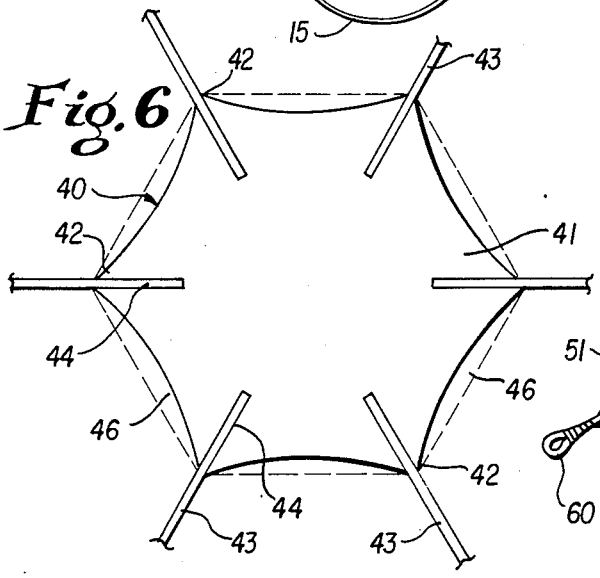
FIG. 6 is a second alternate embodiment of the invention showing a six-sided sea anchor.

With respect to FIG. 6, another embodiment of the present invention is shown. In this embodiment the sea anchor 40 includes a cloth panel member 41 which may be preliminary cut in somewhat the shape of an equalateral hexagon. The panel member includes six side portions which adjoin one another forming six separate vertexes or corners 42. As with the example of FIG. 5, the bail ropes 43 have extended edge portions 44 which are sewn, as in the prior examples, along a line between the corners and the center of the fabric panel. The location of the center may again be determined by dividing each of the angles of the corner in half and extending a line between the corner along that angle and towards the middle of the fabric panel. In deployment, each of the bail ropes will have the same length measured from the center point along the bail member to the point where the bail members are tied or secured together.

In an effort to give the sea anchor shown in FIG. 6 even greater stretch along its diagonal portions, arcuate segments 46 may be cut out as indicated between each of the corners. Generally the more corners that can be utilized the greater the expected efficiency of the sea anchor will be.

Figure 7:
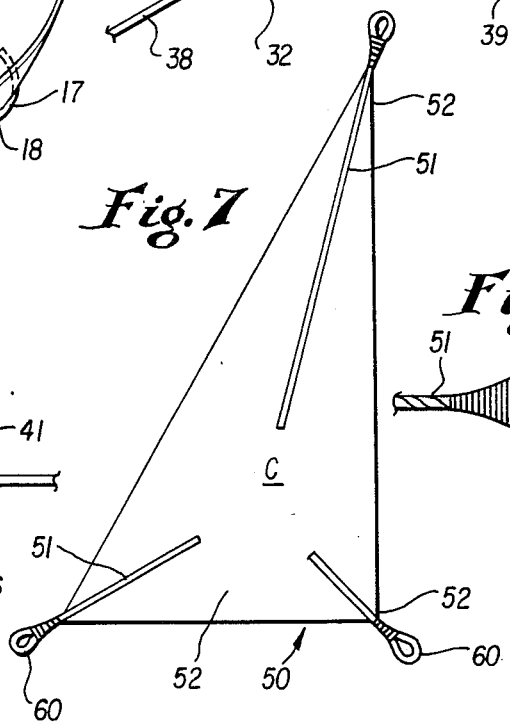
FIG. 7 is another embodiment of the invention showing the method of the present invention when utilized to reinforce a conventional sail for alternate use as a sea anchor.
Figure 8:
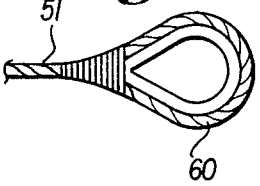
FIG. 8 is an enlarged top plan view of the looped ends of the reinforcing ropes of FIG. 7.

As the method of the present invention permits the use of triangularly shaped panels to perform as sea anchors, the triangular panel shown in FIG. 5 may be somewhat modified to form a reinforced sail for sailboats or a conventional sail may be likewise modified to have utility as a sea anchor. With particular reference to FIGS. 7 and 8, the structure proposed for use in reinforcing a sail 50 is shown wherein reinforcing ropes 51 are extended from the corners 52 thereof toward the center "C". Each of the reinforcing ropes 51 will be sewn in the manner as generally described with regard to the foregoing embodiments. However, when reinforcing a sail, it has been found that the reinforcing ropes should extend within approximately 1 foot of each other in the area of the center. Preferably, approximately a 10 inch diameter circle of cloth should be left free of rope in the area of the center in order to permit the cloth to equalize the stresses thereagainst under varying wind pressures. Therefore, in this embodiment the reinforcing ropes extend generally from the corners to a point within approximately 10 inches of the center of the sail. As with the prior sea anchor embodiments, the reinforcing rope should be placed on the downwind side 52 of the sail so that the reinforcing ropes have the sail urged against the ropes as the sail fills with wind.

As a further modification, the reinforced sail of FIGS. 7 and 8 may be used in emergencies as a sea anchor. In order to accomplish this double function, a loop 60 is formed at the end of each of the reinforcing ropes. In the event a sudden storm or heavy seas were encountered, the sail would be dropped and bail ropes could be attached, by tying or mechanical fasteners, to the looped ends of the reinforcing cord and extended outwardly therefrom a distance as described with respect to the prior embodiments. The ends of each of the bails would then be tied together and secured to a running line which may extend a 150 ft. to 200 ft. As the reinforcing cords are stitched to the sail in the manner prescribed with respect to the embodiments of FIGS. 1 through 6, the triangular sail is already adapted for deployment without further modification being necessary. This joint function permits the operator of a small sailboat to realize increased safety and reduce costs while having a sail which is stronger in construction and adapted to take more wind without damage than a conventionally constructed sail.

From the foregoing embodiments, it is preferred that the center of the sea anchor structure be located at the intersection of lines drawn from the midpoint of the corners of the vertexes of the cloth panel forming the main body of the sea anchor. Such a common midpoint is generally possible where all sides of the main panel are of equal length. Such a common center is also locatable for right triangles, isosceles triangles and the like.

There are, however, circumstances in which a cloth panel member may have sides of an unequal length, but yet provide satisfactory results for use as a sea anchor. This may be particularly true wherein the panel member is formed of a preexisting cloth panel such as a sail for use on a boat, as previously discussed. In these instances, the teachings of the preferred embodiment may be followed with the exception that it may not be possible to locate a single center point where the imaginary lines drawn through the center of the vertexes of the sail intersect. Therefore, in order to locate an approximate center, it is necessary to interpolate from the various points of intersection of the imaginary lines drawn.

The use of cloth panels having no common center point is not as desirable as those that do as there is a tendency for fluid to more easily spill or flow around any side thereof which is shorter than the remaining sides when the panel is used as a sea anchor. The effect of the spillage is to cause lateral movements and undesirable fluctuations of the sea anchor in the water. The amount of such fluctuation can be balanced somewhat by locating the imaginary midpoint as best as possible using the imaginary line technique discussed above.

For purposes of definition, in this application the term of approximate center refers to that point in a sea anchor body or sail panel which is defined by an interpolation of a midpoint using the intersections of lines drawn from the vertexes of the panel toward the central portion of the panel and which divide the angle defined by each vertex generally in half.

With reference again to FIGS. 7 and 8, in the event the imaginary lines from the midpoint of each of the vertexes 52 did not intersect at the center C so that no common intersection was located, then it would be necessary to estimate a point which could be considered to be a midpoint between the pairs of intersections of the three imaginary lines drawn. This midpoint would define the approximate center of the sail.

It should be noted that by sewing the bail ropes along a diagonal line from each corner of a cloth panel in such a manner that the angles of the corner are divided in half that the maximum benefit is obtained from the stretchability of the cloth material. Varying the direction of the bail ropes so that the diagonal extends toward the approximate center will compensate for panel fluctuation during use but may likewise reduce the strength of the seam binding the bail ropes to the cloth panel.

I claim:

1. A sea anchor apparatus comprising a flexible panel member having front and back sides, at least three side edges and a central portion, said flexible panel member being formed of a single homogenous fabric material so that the threads thereof are substantially continuous between said side edges, said side edges intersecting with one another to form at least three spaced vertexes, each of which are generally aligned through said central portion of said panel member, bail rope means extendable from each of said vertexes of said panel member and having an end portion extending in overlaying relationship to the back side of said panel member, seam means connecting each of said end portions of said bail rope means to said back side of said panel member so that said bail rope means are sewn to and extend from each of said vertexes toward said central portion of said panel member, said seam means and said bail rope means terminating in spaced relationship from said central portion of said panel member, and each of said bail rope means extending outwardly from said panel member a generally equal distance with respect to said central portion of said panel member.

2. The sea anchor apparatus of claim 1 in which said end portions of said bail rope means are only partially enclosed by said seam means so that said end portions extend outwardly with respect to said back side of said panel member.

3. The sea anchor apparatus of claim 2 in which each of said seam means includes at least one line of stitching which extends through and joins two generally parallel spaced portions of said panel member and said end portions of said bail rope means.

4. The sea anchor apparatus of claim 3 in which approximately one-half of the circumference of the end portions of said bail rope means are in contact with said panel member.

5. The sea anchor of claim 1 in which said end portions of said bail rope means extend approximately $\frac{1}{4}$ to $\frac{1}{2}$ the distance between said vertexes and the central portion of said panel.

6. The sea anchor apparatus of claim 5 in which said fabric material is of a weight of at least approximately 7 ounces per square yard.

7. The sea anchor apparatus of claim 6 in which said bail rope means are bound together at a common location forwardly of said front side of said panel member.

8. The sea anchor apparatus of claim 7 in which weight means are attached adjacent said common location at which said bail rope means are bound together.

9. The sea anchor apparatus of claim 8 in which said panel member includes equilateral edge portions which extends between said vertexes.

10. The sea anchor apparatus of claim 9 in which said edge portions of said panel member are generally concave in configuration between each of said vertexes.

11. A combination sea anchor and sail apparatus comprising a flexible panel member having front and back sides, at least three side edges and a central portion, said flexible panel member being formed of a single homogenous fabric material so that the threads thereof are substantially continuous between said side edges, said side edges intersecting with one another to form at least three spaced vertexes, each of which are generally aligned through said central portion of said panel member, bail rope means extendable from each of said vertexes of said panel member and having an end portion extending in overlaying relationship to the back side of said panel member, seam means connecting each of said end portions of said bail rope means to said back side of said panel member so that said bail rope means are sewn to and extend from each of said vertexes toward said central portion of said panel member, said seam means and said bail rope means terminating in spaced relationship from said central portion of said panel member, and each of said bail rope means having loop means adjacent each of said vertexes.

12. The combination sea anchor and sail apparatus of claim 11 in which said end portions of said bail rope means are only partially enclosed by said seam means so that said end portions extend outwardly with respect to said back side of said panel member.

13. The combination sea anchor and sail apparatus of claim 12 in which each of said reinforcing rope means terminate approximately one foot from one another adjacent said center portion.

14. A sea anchor apparatus comprising a flexible panel member having front and back sides, at least three side edges and a central portion, said flexible panel member being formed of a single homogenous fabric material so that the threads thereof are substantially continuous between said side edges, said side edges intersecting with one another to form at least three spaced vertexes, each of which are generally aligned through said central portion of said panel member, bail rope means extendable from each of said vertexes of said panel member and having an end portion extending in overlaying relationship to the back side of said panel member, seam means connecting each of said end portions of said bail rope means to said back side of said panel member so that said bail rope means are sewn to and extend from each of said vertexes toward said central portion of said panel member, and each of said bail rope means extending outwardly from said panel member a generally equal distance with respect to said central section of said panel member.

15. The sea anchor apparatus of claim 14 in which said end portions of said bail rope means are only partially enclosed by said seam means so that said end portions extend outwardly with respect to said back side of said panel member.

16. The sea anchor apparatus of claim 15 in which said fabric material is of a weight of at least approximately 7 ounces per square yard.

17. A method of constructing a combination sea anchor and sail from a single homogenous fabric material so that the threads thereof are substantially continuous between the sides thereof, having front and back sides and using reinforcing cord means comprising the steps of:

(a) Forming the fabric material so as to have at least three spaced vertexes;

(b) Placing a first end of a reinforcing cord means on the back side of the fabric material in a line extending from the center of each vertex of the fabric material inwardly thereof and terminating in spaced relationship with the other reinforcing cord means;

(c) Sequentially folding the fabric material over each of the reinforcing cord means so that portions thereof on either side of the reinforcing cord of the fabric material means are extended outwardly in generally overlapping and parallel relationship with one another with the first end of the reinforcing cord means seated within the fold created therebetween in such a manner that an area of contact approximately equal to one half of the circumference of the reinforcing cord means is created between the fabric material and the reinforcing cord means;

(c) Sewing by stitching generally perpendicularly through the overlapping folded over portions of the fabric material and the reinforcing cord means;

(d) Extending the fabric material outwardly so that a portion of the reinforcing cord means is disposed outwardly of the back side of the fabric material; and (e) Forming loop means with each of the reinforcing cord means adjacent each of the vertexes of the fabric material.

18. A method of fabricating a sea anchor from a one piece homogenous flexible cloth panel member so that the threads thereof are substantially continuous between the edges thereof so as to have a plurality of bail ropes secured thereto including the steps of:

(a) Forming said panel member so as to have at least three spaced corners and a central portion;

(b) Placing a first portion of one of said bail ropes on one side of the panel member in a line extending from the center of each corner toward the central portion of the panel member;

(c) Sequentially folding the panel member over each of the bail ropes so that the portions of the panel member on either side of the bail ropes are extended outwardly in generally overlapping and parallel relationship with one another with the first portion of the bail ropes seated within the folds created therebetween in such a manner that an area of contact approximately equal to one half of the circumference of the bail rope is created between the panel member and the bail rope;

(d) Sequentially sewing by stitching generally perpendicularly through the overlapping folded over portions of the panel member and the bail ropes;

(e) Extending the panel member outwardly so that a portion of the bail ropes are disposed outwardly of the one side of the panel members, and (f) Thereafter extending the bail ropes forwardly of the opposite side of the panel member and securing the same at a common point.

19. The method of claim 18 including the additional step of terminating the bail ropes in spaced relationship with respect to one another adjacent the common center of the panel member.

* * * * *